United States Patent [19]

Calvin

[11] 4,076,155

[45] Feb. 28, 1978

[54] ATTACHMENT FOR HUMAN FIGURE FORM

[76] Inventor: Evangeline M. Calvin, 735 SW. St. Claire, Portland, Oreg. 97205

[21] Appl. No.: 758,946

[22] Filed: Jan. 13, 1977

[51] Int. Cl.[2] ..... A41H 5/00

[52] U.S. Cl. ..... 223/68

[58] Field of Search ..... 223/66, 67, 68

[56] References Cited

U.S. PATENT DOCUMENTS

| | | | |
|---|---|---|---|
| 2,089,267 | 8/1937 | Kalvin | 223/68 |
| 2,177,836 | 10/1939 | Messer et al. | 223/68 |
| 2,329,006 | 9/1943 | Sieve | 223/68 |
| 3,044,671 | 7/1962 | Strumpf et al. | 223/66 |

*Primary Examiner*—Doris L. Troutman

*Attorney, Agent, or Firm*—Kolisch, Hartwell, Dickinson & Stuart

[57] ABSTRACT

An attachment for a human figure form, for increasing the size of the torso region of the form. The attachment may comprise a shell formed of sheet-like material, including frontal, side and rear expanses that extend over and cover front, side and rear expanses of the torso region of the form.

4 Claims, 3 Drawing Figures

ATTACHMENT FOR HUMAN FIGURE FORM

This invention relates to a device which is adapted to be fitted about the form of a human figure, and which is effective when so fitted to change the overall configuration of the human figure form.

In a more specific sense, the invention concerns an attachment taking the form of a shell of sheet-like material, constructed so as to enable it to be mounted on the form of a human figure and which is effective when so mounted to alter the overall shape of the figure.

It is a standard practice for dress shops and stores involved with the selling of women's garments, to employ manikins for the display of such garments. The manikin, which may depict the torso or trunk region of the female figure, or alternatively include the arms, legs and head so as to depict the entire figure, conventionally has the shape of a non-pregnant female. Manikins differ in size and proportions, with some depicting the figure of an early adult with others, for example, depicting a more matronly shape. It is rare, however, to find a manikin depicting the shape of a pregnant female, possibly because of the obvious limitations placed on the use of such a manikin.

What this invention more specifically contemplates is an attachment which may take the form of what is referred to herein as a shell of sheet-like material, which may be mounted on a conventional manikin depicting a non-pregnant female. The shell includes frontal, side and rear expanses, and in the usual instance is configured so that when mounted on the manikin it envelopes the torso region of the manikin. The various expanses mentioned in the manikin may enlarge the buttock, hip, abdominal and breast regions of the figure, in a manner which characterizes the change which takes place in the female on pregnancy. With the attachment in place, a conventional manikin is converted into one which may be employed to display maternity clothes in an attractive and life-like manner.

The attachment may be fitted on conventional manikins of differing heights, sizes and proportions. Thus, use of the attachment affords a dress shop a great degree of flexibility, since any of several manikins that the operator may possess may be converted with the attachment into one suitable for the showing of maternity clothes. The attachment itself may be made of relatively inexpensive material, and is characterized by relatively simple construction, and as a consequence it is capable of being produced at a fraction of the cost of a conventional manikin. Use of the attachment, therefore, affords a relatively inexpensive means for a dress shop operator to enlarge the display capabilities possessed by the operator.

A general object of the invention, therefore, is to provide an attachment for a human figure form for increasing in three dimensions the overall configuration of the form.

More specifically, an object is to provide an attachment which takes the form of a shell of sheet-like material, constructed so as to be fitted about the torso of a human figure form with the shell enveloping the torso and producing enlargement of various body regions depicted by the form.

A further object is to provide an attachment of the type generally described which is versatile and can be fitted on manikins of different sizes and shapes.

Yet another object is to provide an attachment operable to enlarge portions of a human figure form, such as a manikin, which is relatively easily mounted in place, and when so mounted becomes firmly established in position.

These and other objects and advantages are attained by the invention, which is described hereinbelow in conjunction with the accompanying drawings, wherein.

Figure 3:
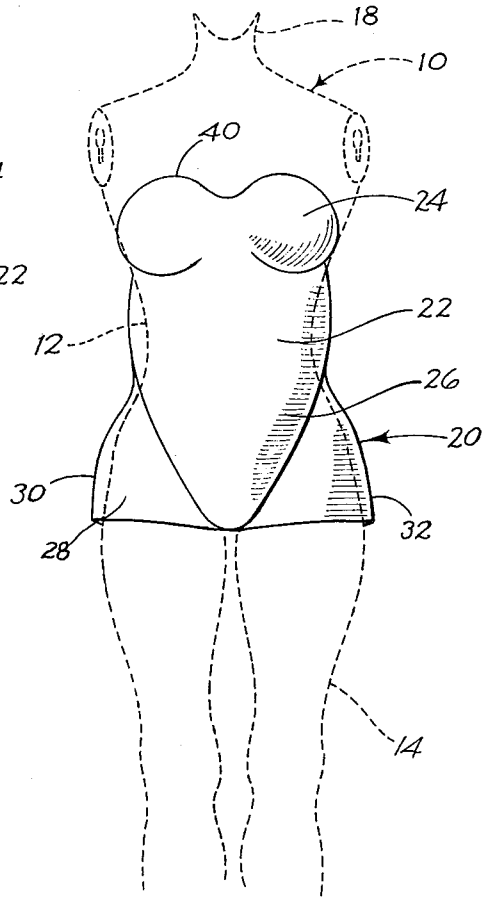
FIG. 3 is a front view of the manikin and attachment shown in FIGS. 1 and 2.
Figure 2:
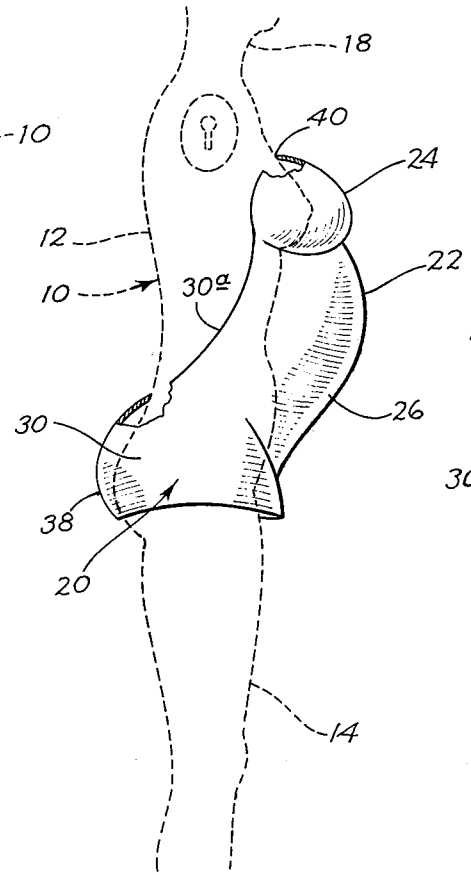
FIG. 2 is a side view of the manikin and attachment shown in FIG. 1.
Figure 1:
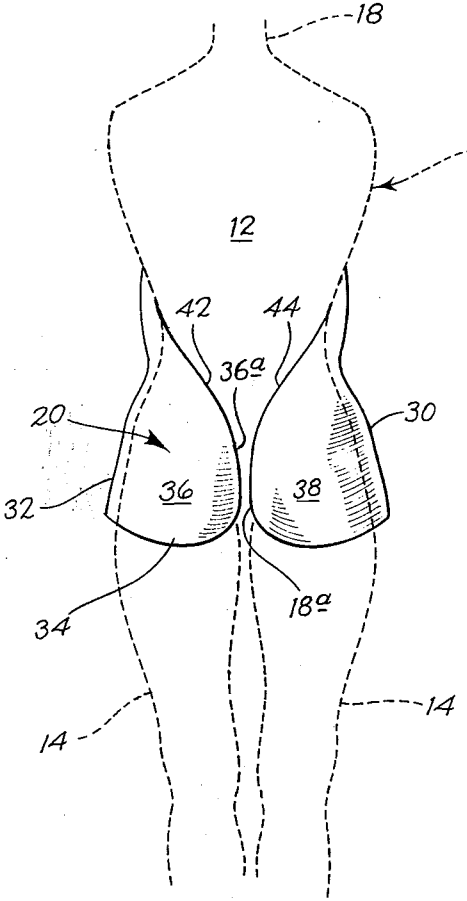
FIG. 1 is a rear view of a manikin (shown in dashed outline), and with the attachment of the invention mounted on such manikin.

Referring now to the drawings, indicated in dashed outline at 10 is a manikin of a conventional type, depicting the figure of a young woman, the manikin illustrated including a torso or trunk region 12, legs 14, and a neck and head 18 (with the head only partially illustrated). The manikin illustrated is devoid of arms.

Mounted on the manikin is the attachment of the invention given the reference numeral 20. The attachment takes the form of what is referred to herein as a shell, and is made of sheet-like material, and the attachment envelopes the torso of the manikin with the attachment mounted in place.

Further explaining, this shell of sheet-like material includes a frontal expanse 22 extending over and covering the front of the human figure form, i.e. the manikin, from adjacent the top of the breasts of the manikin to a region below the abdominal area of the manikin. This frontal expanse includes an upper region 24 shaped to depict the enlarged breasts which characterize a pregnant woman which upper region fits over the breasts of the manikin. Below this upper region is a lower region 26 shaped to depict the enlarged abdominal area which characterizes a pregnant female. Lower region 26 merges with what is referred to herein as skirt portions 28 shaped to portray the enlargement taking place in the upper extremities of a female's legs.

The shell further includes, in addition to frontal expanse 22, opposed side expanses 30, 32. These side expanses join with the front expanse, more specifically with lateral margins of lower region 26 and skirt portions 28. These side expanses are shaped to depict the enlargement which characterizes the enlargement in the hips of a pregnant female.

Also part of the shell which forms the attachment is a rear expanse 34. Such rear expanse takes the form of a pair of so-called buttock panels 36, 38 shaped to depict the buttocks of a pregnant female. Buttock panel 36 joins with side expanse 32, whereas buttock panel 38 joins with side expanse 30.

In the preferred form of the invention the buttock panels present unjoined, opposed margins shown at **36*a*, 38*a***, located approximately midway of the back of the human figure form which has the attachment mounted thereon, and thus midway between the sides of the shell which forms the attachment. The shell, therefore, is divided along the back thereof.

The front, side and rear expanses of the shell define openings at the top and bottom of the attachment adjacent shoulder and upper leg regions, respectively, of the human figure form, in this instance, the manikin. Thus, the shoulders of the manikin extend upwardly of the upper part of the shell attachment, and the legs of the manikin extend downwardly from the lower opening at the base of the attachment.

The attachment is constructed so that it includes zones which bear against and are supported by surfaces in the human figure form that flare outwardly progressing downwardly on the form. More specifically, the upper margin of frontal expanse 22, shown at 40, constitutes a zone bearing against upper parts of the breasts in the manikin. Buttock panels 36, 38 include upper margins or zones 42, 44 which bear against upper buttock areas in the manikin. In this way, the attachment rests on the manikin while being prevented from dropping downwardly on the floor.

The shell which forms the attachment, as earlier explained, is made of sheet-like material. The material has sufficient stiffness whereby the shell holds its shape while providing support for a garment draped thereover.

According to one embodiment of the invention, the shell may be prepared as a unitary piece and have a plastic composition. The shell may be formed on a form or mold to have the shape desired, the shell having essentially uniform wall thickness throughout. The plastic composition of the shell wall provides limited resilient flexibility to the expanses in the shell. For instance, the shell may be prepared from a thin wall of so-called fiberglass, comprising a glass fiber mat reinforced with polyester or epoxy resin. Alternatively, the shell might be prepared from a sheet of cellulosic acetate or modified polystyrene resin, having stiffness but a degree of resilient flexibility.

The attachment comprising the shell described may be mounted on a manikin to convert the manikin into a form for the display of maternity clothing. Typically in order to mount the attachment, the buttock panels at the rear of the shell are drawn apart against the flexible resilience afforded by the side and frontal expanses in the shell. This opens up the shell sufficiently whereby it may be moved into place over the torso region of the manikin. With release of the buttock panels and with the shell in place, margins 40, 42, 44 described bear against manikin surfaces. When mounted in place, side expanses 30, 32 at upper regions such as **30*a***, frictionally engage the sides of the manikin adjacent the waist area, to provide a slight clamping action, additionally contributing to the permanence of the mounting of the attachment.

It should be apparent that the attachment described is usable with other manikins of slightly different configurations, heights, and styles. This is because the walls that form the shell, other than in areas which come into contact with the manikin, are spaced some distance from the manikin proper. The flexible nature of the walls in the shell further permits a spreading of the sides and rear panels, where necessary to accommodate for instance, a larger manikin.

While an embodiment of the invention has been described, it should be obvious that modifications and variations are possible as would be suggested to one skilled in the art.

What is claimed is:

1. An attachment, for a manikin depicting a non-pregnant, female figure, for preparing from the manikin a figure depicting a pregnant woman, the attachment comprising a front expanse of sheet-like material including an upper region in said expanse shaped to depict the enlarged breasts of a pregnant female which upper region fits over the breasts of the manikin, said upper region including an upper margin which bears on the breasts of the manikin to support the attachment, the front expanse further including a lower region shaped to depict the enlarged abdominal region of a pregnant female, opposed side expanses of sheet-like material joined to the lower region of said front expanse, said side expanses depicting the hips of a pregnant female, and a rear expanse formed of sheet-like material, in the form of a pair of buttock panels, one joined to each side expanse, and said panels depicting the buttocks of a pregnant female, said buttock panels presenting unjoined opposed margins located approximately midway between the side expanses of the attachment whereby the attachment is divided along the back thereof, the opposed side and rear expanses having upper margins which together with the upper margin of the front expanse define an opening accommodating the projection therethrough of the shoulder region of a manikin with the attachment mounted on said manikin, the sheet-like material in the attachment having sufficient stiffness whereby the attachment holds its shape while providing support for a garment draped thereover.

2. The attachment of claim 1, wherein said buttock panels include zones which rest on diverging surfaces in the manikin.

3. The attachment of claim 2, wherein the front, side and rear expanses of the attachment are made of flexibly resilient plastic.

4. An enveloping attachment for a human figure form for increasing the size of the torso region in said form, the attachment comprising a front expanse of sheet-like material, including an upper region in said expanse shaped to depict the breasts of a female which upper region fits over the breasts of the human figure form, said upper region having an upper margin which is located adjacent the top of the breasts in the figure form and side margins extending along the sides of the figure form with the attachment placed on the form, the front expanse further including a lower region shaped to depict the abdominal region of a female figure, opposed side expanses of sheet-like material joined to the lower region of said front expanse, said side expanses depicting the hips of a female figure, and a rear expanse formed of sheet-like material comprising a pair of buttock panels, one joined to each side expanse, said buttock panels depicting the buttocks of a female figure and presenting unjoined opposed margins located approximately midway between the side expanses of the attachment whereby the attachment is divided along the back thereof, the opposed side and rear expanses having upper margins which together with the upper margin of the front expanse define an opening accommodating the projection therethrough of the shoulder region of a human figure form with the attachment mounted on said form, the sheet-like material in the attachment having sufficient stiffness whereby the attachment holds its shape while providing support for a garment placing thereover.

* * * * *